United States Patent [19]

Bachler

[11] 4,256,941

[45] Mar. 17, 1981

[54] SPRING OPERATING DEVICES FOR HIGH-VOLTAGE CIRCUIT-BREAKERS

[75] Inventor: Sven Bachler, Ludvika, Sweden

[73] Assignee: ASEA Aktiebolag, Vesteras, Sweden

[21] Appl. No.: 17,120

[22] Filed: Mar. 5, 1979

[30] Foreign Application Priority Data

Mar. 9, 1978 [SE] Sweden ..... 7802673

[51] Int. Cl.[3] ..... H01H 5/10

[52] U.S. Cl. ..... 200/153 SC

[58] Field of Search ..... 200/153 SC, 153 H, 153 C, 200/153 J, 153 R, 154, 320, 337; 74/2; 64/27 B

[56] References Cited

U.S. PATENT DOCUMENTS

| | | | |
|---|---|---|---|
| 3,213,214 | 10/1965 | Hyuga | 200/153 SC |
| 3,470,750 | 10/1969 | Wetter | 74/2 |
| 3,582,591 | 6/1971 | Few | 200/153 SC |
| 3,898,409 | 8/1975 | Liebig et al. | 200/153 SC |
| 3,898,420 | 8/1975 | Evans | 200/153 SC |
| 4,156,803 | 5/1979 | Barkan | 200/153 SC |

*Primary Examiner*—Willis Little

*Attorney, Agent, or Firm*—Watson, Cole, Grindle & Watson

[57] ABSTRACT

In a spring operating device for high-voltage circuit-breakers, opening springs include at least two cooperating torsion bars clamped at one end to each other and connected at the free end to a movable contact of the breaker such that the torsion bars have opposite directions of rotation.

3 Claims, 8 Drawing Figures

SPRING OPERATING DEVICES FOR HIGH-VOLTAGE CIRCUIT-BREAKERS

BACKGROUND

1. Field of the Invention

The present invention relates to a spring operating device for high-voltage circuit-breakers of the type having an opening spring connected to the movable breaker contact.

2. Prior Art

Considerable operating energy is required for the opening operation of $SF_6$ breakers of the puffer type. Since the operating time must also be short, the movable parts of the operating device must have minimum mass. Taking into consideration the stroke length required, a normal screw-wound spring has too great a mass for storing energy in such applications. Instead pneumatic or hydraulic operating devices have been used with pressurized gas to store energy. However, such operating devices with compressors, pumps and other necessary auxiliary equipment are relatively expensive.

SUMMARY OF THE INVENTION

The object of the invention is to provide an operating device for a high-speed high-voltage circuit-breaker, preferably a sulphur hexafluoride circuit-breaker of puffer type, in which the time from tripping impulse to completed breaking may be at most two cycles, i.e. 33 ms in a 60 Hz system.

The above disadvantages can be avoided by using torsion bars in accordance with the present invention to store the energy required to open the breaker, these bars operating pairwise and with opposite directions of rotation. A torsion bar for storing a certain quantity of energy has admittedly the same mass as a corresponding screw-wound spring. However, the mass of the torsion bar does not prevent a rapid withdrawal of energy since the mass is concentrated close to the axis of rotation and the moment of inertia of the bar is therefore slight.

Since two torsion bars cooperate in that they are permanently connected together at one end and arranged to operate with opposite directions of rotation at the other end, the considerable reaction forces and reaction torque which would otherwise have to be absorbed in a built-in frame are eliminated. The cross-beam connecting the bar ends must obviously transmit the torque from one bar to the other and is therefore affected by a bending moment, but this entails no problems.

In an $SF_6$ breaker, space is usually available under the breaker tank for the torsion bars. These can thus be arranged parallel to, and in close conjunction with, the breaker tank, thus providing a considerable saving in space. Most outdoor circuit breakers of other types also can be provided with torsion bars in a similar manner.

A torsion spring pair can also be used to close the circuit breaker. The energy in this spring should be such that it suffices both for the actual breaker operation and for tensioning the opening spring. The system then corresponds to the conventional system for oil circuit breakers, and the energy stored is sufficient for an OFF-ON-OFF cycle.

BRIEF DESCRIPTION OF THE DRAWINGS

The invention will be further described with reference to an embodiment shown by way of example in the accompanying drawing.

DETAILED DESCRIPTION

Figure 1:
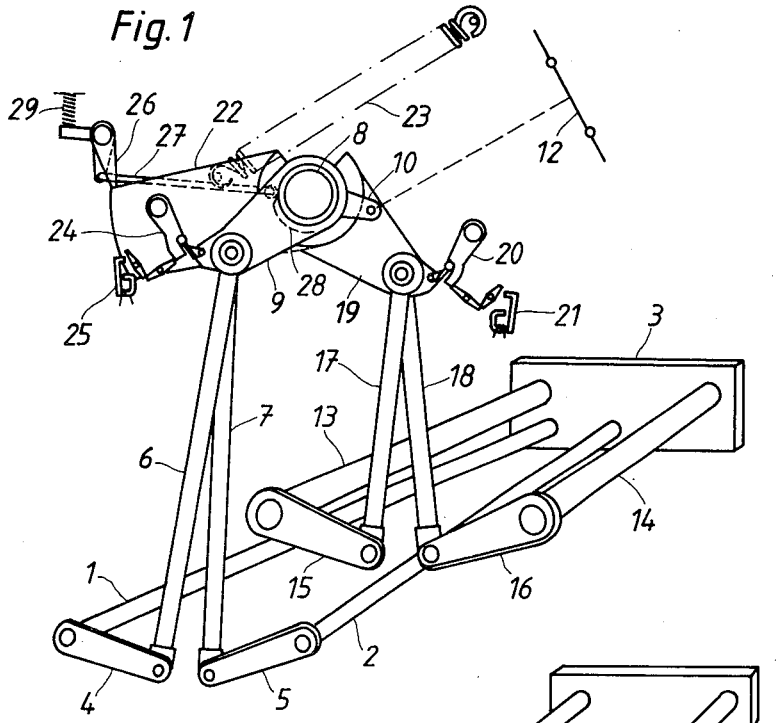
FIG. 1 shows partly in perspective an operating device according to the invention for a high-voltage circuit breaker, in normal operating position, i.e. with the breaker closed and the closing spring under tension.

The operating device shown in the drawing has an opening spring consisting of two spring steel torsion bars 1, 2 arranged in parallel and fixed in cross-beam 3. Each torsion bar may have a length of about 2 m, for instance, and a diameter of about 50 mm. The movable ends of torsion bars 1, 2 are connected via arms 4, 5 and rods 6, 7 to breaker arm 9 fixed to pivotable axis 8 in such a way that the bars operate in opposite rotary directions. Arm 10 is also secured to shaft 8 and connected via rod 11 to movable contact 12 of the breaker (not shown).

Two parallel torsion bars 13, 14 fixed in cross-beam 3 are used to close the breaker. The movable ends of torsion bars 13, 14 are connected via arms 15, 16 and rods 17, 18 to operating arm 19, pivotable about shaft 8. When the closing spring is under tension, arm 19 is arrested by stationary blocking device 20 which can be released by closing magnet 21.

Closing arm 22 is pivotably arranged about shaft 8 and is actuated in one direction of movement by operating arm 19 during a closing operation, and in the opposite direction by return spring 23.

On closing arm 22 is blocking device 24 consisting of three cascade-connected roller-type ratchets which can be released by stationary tripping magnet 25. When the breaker is closed (FIGS. 1 and 5) breaker arm 9 is connected to closing arm 22 with the help of blocking device 24. The breaker is retained in the closed position by stationary blocking device 26 which arrests closing arm 22. Blocking device 26 is released during an opening operation due to the action of rod 27 guided by cam 28 on shaft 8. When the breaker is closed, blocking device 26 is returned to its blocking position by return spring 29.

Figure 3:
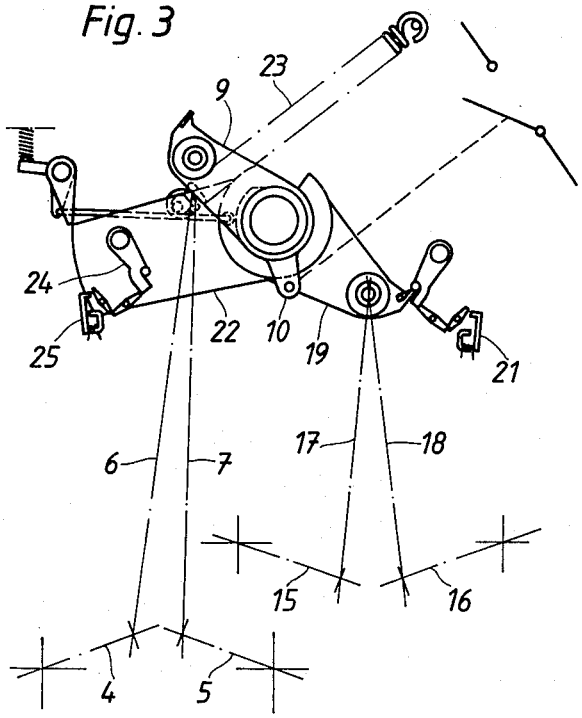
FIG. 3 shows the operating device immediately after an opening operation, the closing mechanism being still in the closed position.

FIG. 1 shows the operating device is normal operating position. The breaker is closed and both opening springs 1, 2 and closing springs 13, 14 are under tension. If an operating impulse is received by tripping magnet 25, blocking device 24 is released and opening springs 1, 2 quickly turn the movable contact of the breaker to the open position (FIG. 3).

Figure 4:
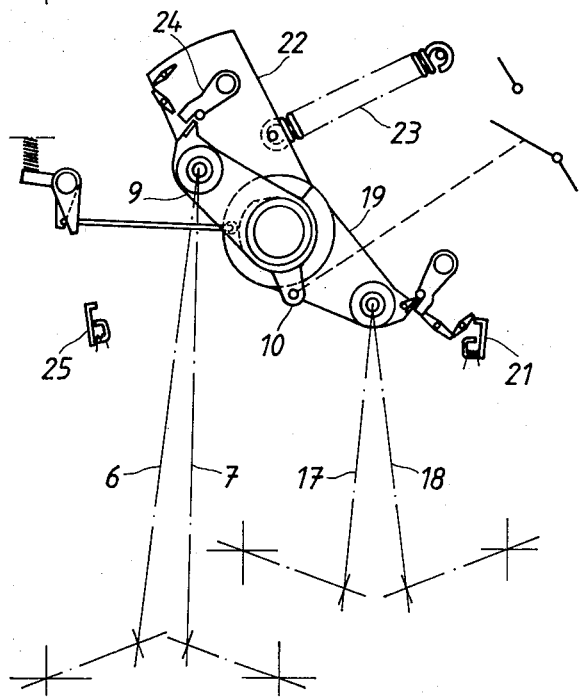
In FIG. 4 the breaker is in the open position and the mechanism is ready for closing.

Cam 28 arranged on shaft 8 actuates rod 27 during the opening movement, and rod 27 moves blocking device 26 out of the way of closing arm 22. Due to the action of return spring 23 closing arm 22 is then turned clockwise and, with the assistance of blocking device 24, closing arm 22 moves into engagement with breaker arm 9 (FIG. 4).

Figure 5:
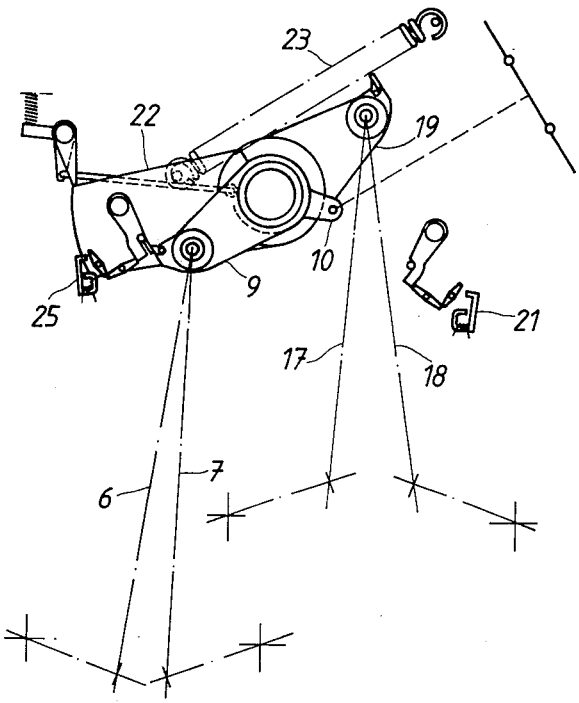
In FIG. 5 the breaker is closed and the closing spring is unloaded.
Figure 6:
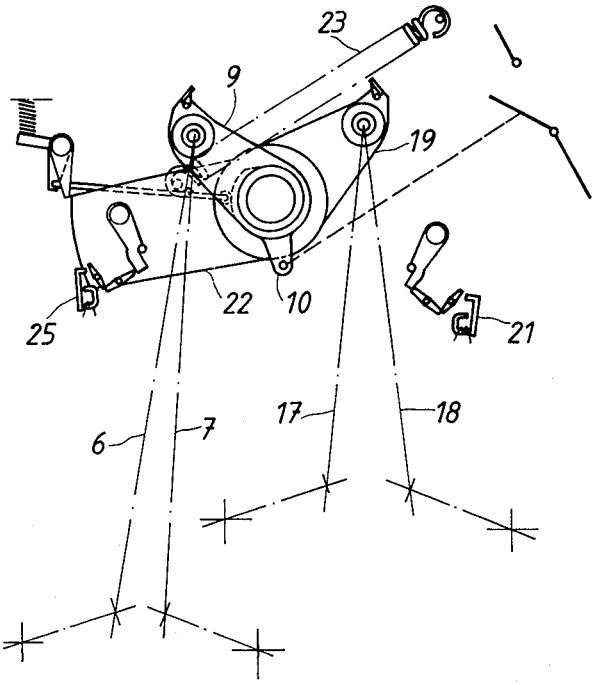
FIG. 6 shows the operating device immediately after an 0N-OFF operation, the breaker being open, the closing and opening springs being unloaded (relaxed), and the closing mechanism being in the closed position.

To close the breaker (from the open position shown in FIG. 4) an operating impulse is emitted to closing magnet 21 which then releases blocking device 20. Closing springs 13, 14 then turn operating arm 19 and by means of closing arm 22 and breaker arm 9, contact 12 is moved into the closed position. At the same time blocking device 26 moves into blocking engagement with closing arm 22 (FIG. 5). During the closing operation opening springs 1, 2 are tensioned. The breaker can therefore be tripped immediately after closing (FIG. 6).

A force profile is designed for the opening movement of a puffer breaker, which is characterized by a considerable force at the start in order to effect rapid opening, thereafter reduced force to maintain the contact speed, and finally an extremely great force in order to overcome the puffer pressure in the final stage.

Figure 2:
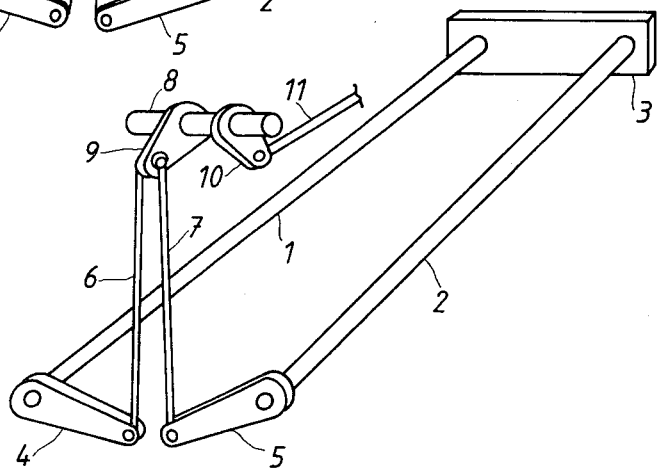
FIG. 2 shows separately the arrangement of the opening spring for the operating device.
Figure 7:
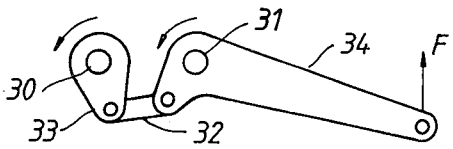
FIGS. 7 and 8 show an alternative arrangement of the opening spring in two different positions.
Figure 8:
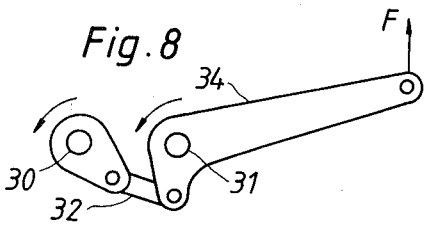

By connecting two torsion bars 30, 31 in parallel by link 32 joining two arms 33, 34, one secured to each of the torsion bars, with suitably selected geometry (FIGS. 7 and 8), it is possible to achieve a resultant force F with a profile approaching that desired. In FIGS. 7 and 8 torsion bars 30, 31, link 32 and arms 33, 34 correspond to torsion bar 1 and arm 4 of FIG. 2, i.e., one-half of the opening spring mechanism. Then, in this alternative embodiment the opening spring consists of four torsion bars (or of several groups of four torsion bars operating in parallel).

The closing spring is tensioned by a tension device which starts automatically immediately after each closing operation. The operating device is therefore generally always ready for auto-reclosing immediately after an opening operation.

What is claimed is:

1. Spring operating device for high-voltage circuit-breakers, comprising:

a support; an opening spring including at least two cooperating torsion bars arranged substantially parallel to each other with one end of each of said bars being permanently clamped to said support; a radially directed operating arm provided at the other end of said bars; and a rod system connected to said operating arms to transmit the spring force to the movable contact of a circuit-breaker, said operating arms and rod system being so arranged that said torsion bars have opposite directions of rotation.

2. Operating device according to claim 1, further comprising a closing spring for closing the breaker and tensioning said opening spring, said closing spring consisting of torsion rods arranged in the same manner as said torsion rods of said opening spring.

3. Operating device according to claim 2 or 1, wherein said opening spring comprises at least four torsion rods which are connected together pairwise by links such that an increasing opening force is obtained towards the end of the opening movement.

* * * * *